US005834165A

United States Patent [19]

Hirabayashi

[11] Patent Number: 5,834,165

[45] Date of Patent: Nov. 10, 1998

[54] METHOD FOR PROCESSING SILVER HALIDE LIGHT SENSITIVE PHOTOGRAPHIC MATERIAL

[75] Inventor: Kazuhiko Hirabayashi, Hino, Japan

[73] Assignee: Konica Corporation, Tokyo, Japan

[21] Appl. No.: 902,242

[22] Filed: Jul. 29, 1997

[30] Foreign Application Priority Data

Aug. 8, 1996 [JP] Japan ..... 8-209742

[51] Int. Cl.[6] ..... G03C 5/29

[52] U.S. Cl. ..... 430/372; 430/428; 430/429; 430/463

[58] Field of Search ..... 430/372, 398, 430/428, 463, 429

[56] References Cited

U.S. PATENT DOCUMENTS

| | | | |
|---|---|---|---|
| 4,752,556 | 6/1988 | Kishimoto | 430/463 |
| 4,873,179 | 10/1989 | Abe et al. | 430/463 |
| 4,960,683 | 10/1990 | Okazaki et al. | 430/428 |
| 5,009,983 | 4/1991 | Abe | 430/372 |
| 5,034,308 | 7/1991 | Abe et al. | 430/398 |
| 5,055,381 | 10/1991 | Abe et al. | 430/463 |
| 5,077,179 | 12/1991 | Abe et al. | 430/463 |

FOREIGN PATENT DOCUMENTS

| | | |
|---|---|---|
| 0 392 443 | 10/1990 | European Pat. Off. . |
| 2-23342 | 1/1990 | Japan . |
| 7-56301 | 3/1995 | Japan . |

*Primary Examiner*—Hoa Van Le

*Attorney, Agent, or Firm*—Frishauf, Holtz, Goodman, Langer & Chick, P.C.

[57] ABSTRACT

A processing method of a silver halide photographic material by using an automatic processor is disclosed, comprising the steps of developing an exposed photographic material with a developing solution in a developing tank, fixing with a fixing solution in a fixing tank and washing with a washing water or a rinsing solution in a washing tank, wherein the washing water or rinsing solution has the number of funguses of 100 or less per ml.

8 Claims, No Drawings

METHOD FOR PROCESSING SILVER HALIDE LIGHT SENSITIVE PHOTOGRAPHIC MATERIAL

FIELD OF THE INVENTION

The present invention relates to a method for processing a silver halide light sensitive photographic material and in particular to a processing method resulting in improved residual color.

BACKGROUND OF THE INVENTION

Silver halide light sensitive photographic materials (hereinafter, referred to as photographic materials) are, after exposed, subjected to processing comprising steps of developing, fixing, washing (or rinsing), etc. The processing is generally carried out using an automatic processor (hereinafter, referred to as processor).

Recently, improvements of shortening of the processing time and lowering of the replenishing rate of processing solutions have been made, and partially due thereto problems concerning residual color of processed photographic materials have been noted. Generally, residual coloring occurs over all the photographic material and sometimes spot-like dye coloring also occurs. This is due to dyestuffs or spectral sensitizing dyes which are not completely decolorized or leached out of a processed photographic material and which accumulate on rollers after the washing step and thereby become attached to the photographic material.

A number of techniques for reducing residual coloring have been proposed to date. For example, JP-A 1-159645 (the term, "JP-A" means unexamined, published Japanese Patent Application) discloses lowering of residual color by the use of a mercapto compound, or JP-A 2-71260 discloses reduction by using heterocyclic compounds. However, neither of these techniques achieve acceptable levels improvements.

SUMMARY OF THE INVENTION

It is an objective of the invention to provide a method for processing a photographic material, which exhibits reduced residual coloring. The above objective of the invention is accomplished by:

(1) A method for processing a photographic material having a silver halide emulsion layer by using a processor, wherein the photographic material is processed with water in which the number of fungi is 100 or less per ml;

(2) preferably, the processing method described in (1), characterized in that the amount of water or rinsing solution used in the washing or rinsing step of the processor is 30 ml to 6 liters per $m^2$; and (3) preferably, the processing method described in (1) and (2), characterized in that in the washing or rinsing step of the processor, the immersion time in the water or the rinsing solution is between 1 and 10 sec.

DETAILED DESCRIPTION OF THE INVENTION

In the invention, the referred to fungi are a germ such as bacteria or mold. The number thereof can be determined in the following manner.

Surface Plate Method:

1. A medium which has been sterilized is transferred to a sterilized petri dish and coagulated therein to form a planar medium. As the medium are employed a broth extract agar medium for detecting bacteria and a potato-dextrose agar medium for detecting the mold.

2. After allowing condensed water to evaporate from the surface of the planar medium as described above, 0.1 ml of a sample is placed thereon and spreaded out over the surface of the planar medium using a stirring stick.

3. The planar medium is turned over and incubated in an incubator, in which the bacteria is cultured for 48 hrs. at 37° C. and the mold is cultured for 1 week at 25° C.

4. After incubation, the number of colonies growing on the surface of the medium are counted and 10 times the number of colonies is used to represent as the number of fungi.

Effects of the invention are remarkable at a washing flow rate of not more than 6 liters/$m^2$, though it is also effective at more than 6 liters/$m^2$. The effective immersion time in washing water or a rinsing solution is between 1 sec and 10 sec. In the case of less than 1 sec., an excessive amount of fixer components remain in the photographic material.

The number of fungi in the washing water or the rinsing solution is preferably 100 or less per ml and more preferably 10 or less per ml. The washing water or rinsing solution used in the invention includes not only fresh water but also water in a washing tank or rising tank under continuous processing.

Reduction of the number of fungi to 100 or less per ml can be accomplished by various means, such as electrolysis, the use of an antibacterial agent, ultraviolet-ray irradiation, exposure to ozone, the use of an oxidizing agent, the use of an antimold agent, ultrasonic methods and heating methods.

The above means will be described further in detail.

Usable as an electrode used in the electrolysis is any commercially available one, such as a metal electrode and carbon electrode. An electrode with as large a surface area as possible is preferred and more preferred is porous graphite. The electrode potential is preferably 0.74 V or more (vs. a saturated calomel electrode).

As the antibacterial agent is usable any compound or element capable of reducing the number of fungus to 100 or less per ml, based on the determination thereof, as described above, including metallic soap, ceramics, silver and copper. Further, an oxidizing agent, reducing agent,acid, base, zinc compound, aliphatic imide compound, quaternary ammonium compound, metal phthalocyanine, silver zeilite, phosphate salt, halo-di-allylurea, guanidine, phenol derivative and fatty acid ester are also usable. Examples of commercially available antibacterial agents include Apacider A35, Apacider A25, Apacider AW and Apacider NB (each, trade name, produced by Sangi Corp.), zinc stearate, magnesium stearate, lithium stearate, Holon Killer beads celler, 37-135, T37-035W, T19-033W, CC37-105W (trade names, produced by Nikko Co.); amino acid metallic soap such as aminometal, Zeomic (produced by Shinanen Co.), Bactekiller (trade name, produced by Kanebo), Ion-pure (trade name, produced by Ishizuka Glass Co.), antibacterial ceramics produced by Shito V Ceracs, Ice (produced by Shokubai Kasei) and Novalon (produced by Toa Gosei).

It is preferred that the washing tank is previously treated with the antibacterial agent.

In a preferred embodiment, at least one of these antibacterial agents is kneaded into a resin used for tanks, gears, rollers or guides of the washing or rinsing bath. In another embodiment, the antibacterial agent can also be contained in a coating on the bottom or walls of the tank. In these cases, the antibacterial agent is preferably contained in an amount of 0.5 to 10% by weight.

Examples of the oxidizing agent include a metallic or nonmetallic oxide such as an iron oxide and its salt, oxyacid, peroxide, and organic acids. The oxyacid is preferably sulfuric acid, nitric acid, nitrous acid or hypochlorous acid. The peroxide is preferably hydrogen peroxide or Fenton's reagent.

The antimold usable in the invention is any one of those which do not adversely affect photographic performance. Examples thereof include thiazolone compounds, isothiazolone compounds, chlorophenol compounds, bromophenol compounds, thiocyanate or isothiocyanate compounds, diol compounds, acid azide compounds, diazine or triazine compounds, pyrithione compounds, thiourea compounds, alkylguanidine compounds, quaternary ammonium compounds, organic tin compounds, organic zinc compounds, cyclohexylphenol compounds, imidazole or benzimidazole compounds, sulfamide compounds, active halogen type compounds such as chlorinated isocyanuric acid sodium salt, chelating agents, sulfite compounds and antibiotics such as penicillin.

Further, there are also usable a bactericide described in L. E. West "Water Quality Criteria" in Phot. Sci. and Eng., Vol.9, No.6 (1965), a variety of antimolds described in JP-A 57-8542, 58-105415, 49-126533, 55-111942 and 57-157244 and compounds described in H. Horiguchi, "Chemistry of Antimold and Antibacteria" published by Sankyo Shuppan (1082) and Nihon Bohkin Bohbai Gakkai, "Bohkin-Bohbai Gijutsu Handbook" published by Gihodo (1986).

Of above antimolds are preferred isothiazolone compounds, diol compounds, pyrithione compounds and chlorinated isocyanuric acid compounds. Preferred isothiazolone compounds are represented by the following formula (I):

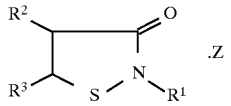

Formula (I)

In the Formula, $R^1$ represents a methyl group or octyl group; $R^2$ and $R^3$ each represent a hydrogen atom or halogen atom, and may be identical or different from each other. Z represents a copper salt or magnesium salt, including copper chloride, copper nitrate, copper sulfate, magnesium chloride, magnesium nitrate and magnesium sulfate.

Examples of the isothiazolone compound represented by formula (I) include 2-methylisothiazoline-3-one.magnesium nitrate, 2-methyl-4-chloroisothiazoline-3-one.magnesium nitrate, 2-methyl-5-chloroisothiazoline-3-one.magnesium nitrate, 2-methyl-4,5-dichloroisothiazoline-3-one.magnesium nitrate, 2-octylisothiazoline-3-one.magnesium nitrate, 2-octyl-4-chloroisothiazoline-3-one.magnesium nitrate, 2-octyl-5-chloroisothiazoline-3-one.magnesium nitrate, 2-octyl-4,5-dichloroisothiazoline-3-one.magnesium nitrate, and compounds in which a magnesium chloride, magnesium sulfate, copper nitrate, copper chloride or copper sulfate is contained as Z of formula (I).

The isothiazolone compound may be used singly or in combination.

A composite of an isothiazolone and metal salt, as represented by formula (I), is superior in stability in water, as compared to an isothiazolone itself. Since the isothiazolone itself is easily decomposed in water, there can not be employed water as a solvent. Instead thereof are employed glycols such as diethylene glycol, as a solvent. For example, Caisson-free (trade name, produced by Rohm & Haas Co.) and Zonen F (trade name, produced by Ichikawa Gosei Co.) are commercially available.

On the other hand, the composite of a isothiazolone and metal salt, as represented by formula (I), is stable in water, so that it is commercially available in the form of an aqueous solution. Examples thereof include Caisson WT, Caisson MW, Caisson LX (each, produced by Rohm & Haas Co.) and Zonen C (produced by Ichikawa Gosei Co.). As the compounds represented by formula (I), those which are commercially available or prepared by causing a isothiazolone to react with a magnesium or copper salt, can be employed.

The diol compounds are effective in preventing fur to occur, and 2-bromo-2-nitropropane-1,3-diol, e.g., is employed. The isothiazolone compound represented by formula (I) is preferable employed in combination with the diol compound. A weight ratio thereof is preferably between 1:10 and 10:1.

A preferred pyrithione compound is a 2-pyridylthiol oxide compound, in the form of a metallic salt represented by the following formula (II). The metallic salt is preferably an alkali metal salt or zinc salt and more preferably an alkali metal salt such as sodium salt.

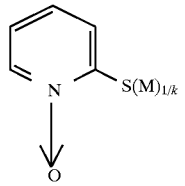

Formula (II)

In the Formula, M represents an alkali metal such as Na or zinc metal (Zn); and k represents a valence number of M. The above compound can be employed in the form of a complex salt of a metal, such as an iron ion. Further, the compound may be employed in combination with a known triazine compound.

The 2-pyridylthiol oxide metal salt represented by formula (II) or its metal complex salt is commercially available, and it can be employed as such. Exemplarily is known OMADINE (trade mark, product by U.S. Orion Co.), and Sodium Omadine (trade name, sodium salt), Zinc Omadine (trade name, zinc salt) and Ferric Omadine (trade name, ferric salt) are commercially available in the form of an aqueous solution. Further, a triazine compound which is to be effective in combination with the above compound, is also commercially available as trade name of Triadine-10 (product by U.S. Orion Co.).

The pyrithione compound may be added to the washing water or rinsing solution prior to the start of processing, or directly supplied to a washing tank or rinsing tank of a processor at optimal time intervals.

The compound may be added, in a given proportion, into the washing tank or rinsing tank, or the washing water or rinsing solution, every time a predetermined amount of photographic material is processed. Further, the compound may be added in a given proportion while the processor is operating, whether the photographic material is being processed or not.

The addition amount is from 0.01 ppm to solubility and preferably 0.1 to 50 ppm per liter of washing water. Taking into account the sequences of additives, it is preferable to add an aqueous solution with an optimal concentration, e.g., 0.05 to 5%. The pH of the solution is preferably 4 or higher and more preferably 4 to 9 in terms of practical use.

Chlorinated cyanuric acids are also preferably used. Examples thereof include dichloroisocyanuric acid and trichlorocyanuric acid. They can be used in the form of an acid as such or its salt. Any of several water soluble salts may be used, however, alkali metal salts, such as sodium dichlorocynurate are preferred. Chlorinated cyanuric acids and their salts are commercially available and can be readily obtained. The concentration of the chlorinated cyanuric acid in water is 5 to 200 ppm and preferably 10 to 70 ppm, based on effective chlorine concentration.

There are also available an antibacterial and antimolding means in sheet form. A Clean Bio-sheet (trade name) is employed with introducing air, which, for example, is allowed to settle in a washing tank. Clean Bio-sheet is produced by Tokyo Biotechs Co., sold by Art Biowork Co. and commercially available in sheet-form member.

Exemplary examples of an ozone generator to perform antibacterial and antimold functions using ozone, include Pasteur Ozonizer LB series produced by Ozone Co., Ozonizer produced by Laycy Co. and an ozone generator produced by Nikko Kinzoku Kogyo Co.

Presuming that the volume of a washing tank is about 15 liters, the ozone supplying amount (or generating amount) is preferably 0.72 to 1.44 mg/hr. The ozone supplying amount can be optionally set or varied by adjusting the applied voltage of the ozone generator. The setting or varying is performed through a control means. The ozone supplying amount can be determined from the total amount of discharged gas and the concentration of ozone in the ozone generator. The concentration of ozone can be measured, for example, using Ozone concentration measuring instrument Model DY-1500, produced by Osaka Direx Co.

Sterilization by ultra-violet (UV) rays is described in "Shokuhin-kogyo no Senjo to Sakkin" (Washing and Sterilization in Food Industry), Chapter 13, published by Eisei Gijutsukai (1981). Techniques described therein are applicable to the present invention. There are employed various types of UV lamps, such as a straight tube type, a U-tube type, a V-tube type, a circular tube type and a double tube type. The output is preferably 4 to 60 W. Exemplarily, a low pressure mercury lamp is often employed. UV wavelengths of 220 to 300 nm effectively perform sterilization to decompose any ozone to produce active oxygen, and most effective are wavelengths of 253–255 nm.

With regard to ultrasonic methods, there are employed ultrasonic generators with much lower output than those used for washing instruments, on the order of 100 mW or less. Accordingly, an apparatus becomes very simple and alkali batteries are sufficient as an electrical power source. The generator can be operated only when a processor is running. Washing water can be subjected to ultrasonic action continuously or only when the processor is running. Under these conditions, fur or mold is barely produced in the tank. There can also be employed plural ultrasonic apparatuses.

Heat sterilization is preferably conducted with a heater, whereby the replenishing water or replenishing rinse solution to a temperature of 60° C. or higher.

Photographic materials used in the present invention are not specifically limited, and the present innovation is applied to photographic materials known in the art or those prepared by a variety of known techniques. With respect to processing chemicals and methods, there is specifically no limitation and those known in the art are applicable.

EXAMPLES

Embodiments of the present invention will be explained based the following examples.

Example 1

Preparation of photographic material 1

Preparation of silver halide emulsion A:

Silver bromochloride core grains having an average chloride content of 70 mol %, an average thickness of 0.05 μm and an average diameter of 0.15 μm were prepared by double jet precipitation. During precipitation was added $K_3RuCl_6$ of $8\times10^{-8}$ mol per mol silver. Further on the core grains was formed shell by the double jet precipitation. During precipitation was added $K_2IrCl_6$ of $3'10^{-7}$ mol per mol silver. The resulting emulsion was comprised of core/shell type, monodisperse silver iodobromochloride tabular grains (chloride of 90 mol % and iodide of 0.2 mol %) having an average thickness of 0.10 μm, an average diameter of 0.25 μm and (100) major faces. Subsequently, the emulsion was desalted to remove soluble salts using modified gelatin described in JP-A 2-280139 (phenylcarbamyl-substituted gelatin, e.g., G-8 exemplified in JP-A 2-280139). The EAg of the desalted emulsion was proved to be 123 mV at 50° C.

To the emulsion was added 4-hydroxy-6-methyl-1,3,3a,7-tetrazaindene of $1\times10^{-3}$ mol per mol of silver and then the pH and EAg of the emulsion were respectively adjusted to 5.6 and 123 mV by adding potassium bromide or citric acid. After adding thereto chloroauric acid of $2\times10^{-5}$ mol per mol of silver, simple substance of sulfur of $3\times10^{-6}$ mol per mol of silver was added and chemical ripening was conducted at a temperature of 60° C. until reached a maximum sensitivity. After ripening were added 4-hydroxy-6-methyl-1,3,3a,7-tetrazaindene of $2\times10^{-3}$ mol per mol of silver, 1-phenyl-5-mercaptotetrazole of $3\times10^{-4}$ and gelatin.

Preparation of silver halide emulsion B:

Silver iodobromochloride core grains having an average chloride content of 70 mol % and iodide content of 2.5 mol %, an average thickness of 0.05 μm and an average diameter of 0.15 μm were prepared by double jet precipitation. During precipitation was added $K_3Rh(H_2O)\ Cl_5$ of $2\times10^{-8}$ mol per mol silver. Further on the core grains was formed shell by the double jet precipitation. During precipitation was added $K_2IrCl_6$ of $3\times10^{-7}$ mol per mol silver. The resulting emulsion was comprised of core/shell type, monodisperse silver iodobromochloride tabular grains (chloride of 90 mol % and iodide of 0.5 mol %) having an average thickness of 0.10 μm, an average diameter of 0.42 μm and (100) major faces. Subsequently, the emulsion was desalted to remove soluble salts using modified gelatin described in JP-A 2-280139 (phenylcarbamyl-substituted gelatin, e.g., G-8 exemplified in JP-A 2-280139). The EAg of the desalted emulsion was proved to be 180 mV at 50° C.

To the emulsion was added 4-hydroxy-6-methyl-1,3,3a,7-tetrazaindene of $1\times10^{-3}$ mol per mol of silver and then the pH and EAg of the emulsion were respectively adjusted to 5.6 and 123 mV by adding potassium bromide or citric acid. After adding thereto chloroauric acid of $2\times10^{-5}$ mol per mol of silver, N,N,N'-trimethyl-N'-heptafluoroselenourea of $3\times10^{-6}$ mol per mol of silver was added and chemical ripening was conducted at a temperature of 60° C. until reached a maximum sensitivity. After ripening were added 4-hydroxy-6-methyl-1,3,3a,7-tetrazaindene of $2\times10^{-3}$ mol per mol of silver, 1-phenyl-5-mercaptotetrazole of $3\times10^{-4}$ and gelatin.

Preparation of photographic material 1 used for He—Ne laser scanner

On a sublayer of one side of a polyethylene terephthalate support were simultaneously coated a gelatin sublayer (formula 1) with a silver coating amount of 1.5 g/m$^2$ and a gelatin coating amount of 0.5 g/m$^2$, thereon, a silver halide emulsion layer 1 (formula 2) with a gelatin coating amount of 1.5 g/m$^2$, further thereon, an interlayer (formula 3) with a gelatin coating amount of 0.3 g/m$^2$, further thereon, a silver halide emulsion layer 2 (formula 4) with a silver coating amount of 1.4 g/m$^2$ and a gelatin coating amount of 0.4 g/m$^2$, and further thereon, an emulsion-protective layer (formula 5) with a gelatin coating amount of 0.6 g/m$^2$. On a sublayer of the other side of the support were also simultaneously coated a backing layer (formula 6) with a gelatin coating amount of 0.6 g/m$^2$, thereon, a hydrophobic polymer layer (formula 7) and further thereon, a backing protective layer (formula 8) with a gelatin coating amount of 0.4 g/m$^2$ to obtain a photographic material sample.

| | |
|---|---|
| Formula 1 (Gelatin sublayer) | |
| Gelatin | 0.5 g/m$^2$ |
| Dye AD-1, solid particle dispersion (average particle size: 0.1 μm) | 25 mg/m$^2$ |
| Poly(sodium styrenesulfonate) | 10 mg/m$^2$ |
| S-1 (sodium isoamyl-n-decylsuccinate) | 0.4 mg/m$^2$ |
| Formula 2 (Silver halide emulsion layer 1) | |
| Silver halide emulsion A (in silver amount) | 1.5 g/m$^2$ |
| Dye AD-8, solid particle dispersion (average particle size: 0.1 μm) | 20 mg/m$^2$ |
| Cyclodextrin (hydrophilic polymer) | 0.5 g/m$^2$ |
| Sensitizing dye d-1 | 5 mg/m$^2$ |
| Sensitizing dye d-2 | 5 mg/m$^2$ |
| Hydrazine compound H-7 | 20 mg/m$^2$ |
| Redox compound RE-1 | 20 mg/m$^2$ |
| Compound e | 100 mg/m$^2$ |
| Latex polymer f | 0.5 g/m$^2$ |
| Hardener g | 5 mg/m$^2$ |
| S-1 | 0.7 mg/m$^2$ |
| 2-Mercapto-6-hydroxypurine | 5 mg/m$^2$ |
| Colloidal silica (av. particle size: 0.05 μm), as shown in Table 2 | |
| Formula 3 (Interlayer) | |
| Gelatin | 0.3 g/m$_2$ |
| S-1 | 2 mg/m$_2$ |
| Formula 4 (Silver halide emulsion layer 2) | |
| Silver halide emulsion B (in silver amount) | 1.4 g/m$^2$ |
| Sensitizing dye d-1 | 3 mg/m$^2$ |
| Sensitizing dye d-2 | 3 mg/m$^2$ |
| Hydrazine compound H-20 | 20 mg/m$^2$ |
| Nucleation accelerating agent Nb-12 | 40 mg/m$^2$ |
| Redox compound RE-2 | 20 mg/m$^2$ |
| 2-Mercapto-6-hydroxypurine | 5 mg/m$^2$ |
| Latex polymer f | 0.5 g/m$^2$ |
| S-1 | 1.7 mg/m$^2$ |
| Formula 5 (Emulsion-protective layer) | |
| Gelatin | 0.6 g/m$^2$ |
| Dye AD-5, solid particle dispersion (average particle size: 0.1 μm) | 40 mg/m$^2$ |
| S-1 | 12 mg/m$^2$ |
| Matting agent (monodisperse silica with av. particle size of 3.5 μm) | 25 mg/m$^2$ |
| Nucleation accelerating agent Na-3 | 40 mg/m$^2$ |
| 1,3-vinylsulfonyl-2-propanol | 40 mg/m$^2$ |
| Surfactant h | 1 mg/m$^2$ |
| Colloidal silica (av. particle size 0.05 μm) | 10 mg/m$^2$ |
| Hardener K-1 | 30 mg/m$^2$ |
| Formula 6 (Backing layer) | |
| Gelatin | 0.6 g/m$^2$ |
| S-1 | 5 mg/m$^2$ |
| Latex polymer f | 0.3 mg/m$^2$ |
| Colloidal silica (av. particle size 0.05 μm) | 70 mg/m$^2$ |
| Poly(sodium styrenesulfonate) | 20 mg/m$^2$ |
| Compound i | 100 mg/m$^2$ |
| Formula 7 (Hydrophobic polymer layer) | |
| Latex (methyl methacrylate:acrylic acid = 97:3) | 1.0 g/m$^2$ |
| Hardener g | 6 mg/m$^2$ |
| Formula 8 (backing protective layer) | |
| Gelatin | 0.4 g/m$^2$ |
| Matting agent (monodisperse polymethylmethacrylate with av. particle size of 5 μm) | 50 mg/m$^2$ |
| Sodium di-(2-ethylhexyl)-sulfosuccinate | 10 mg/m$^2$ |
| Surfactant h | 1 mg/m$^2$ |
| Dye k | 20 mg/m$^2$ |
| $H-(OCH_2CH_2)_{68}-OH$ | 50 mg/m$^2$ |
| Hardener K-1 | 20 mg/m$^2$ |

-continued
Compound i
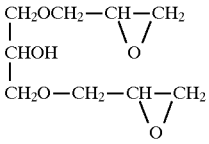
Dye k
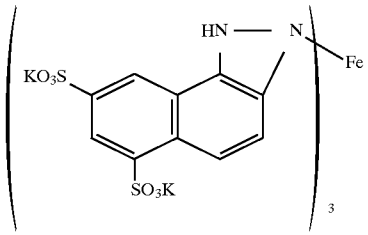
RE-1
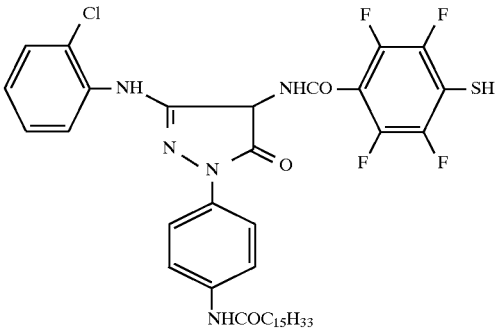
RE-2
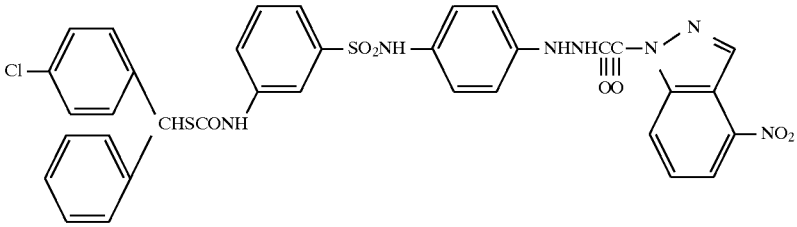
K-1
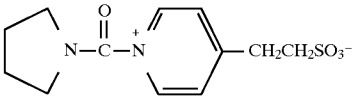
Sensitizing dye d-1
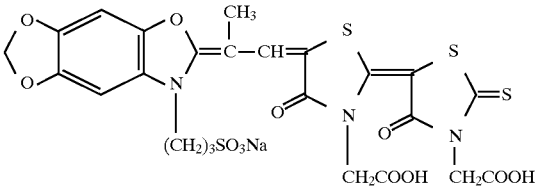

-continued
Sensitizing dye d-2
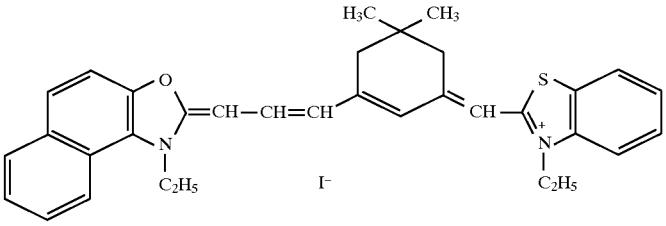
Compound e
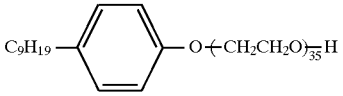
Latex polymer f
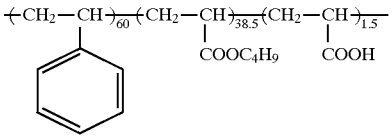
Hardener g
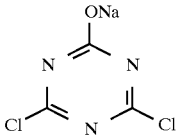
Surfactant h
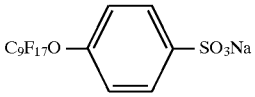
AD-1
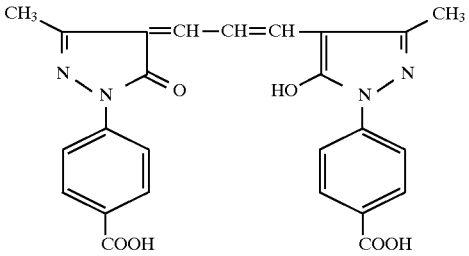
AD-5
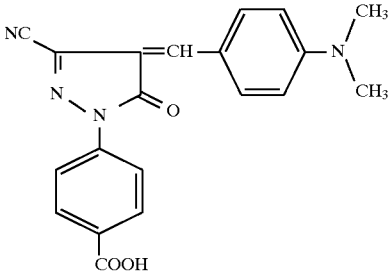

-continued

AD-8

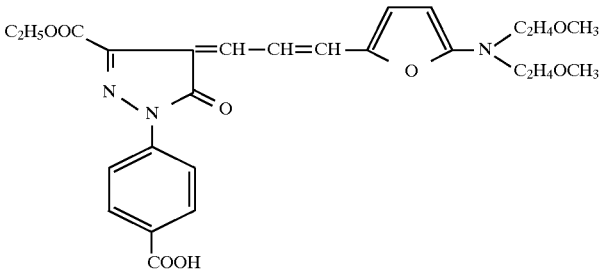

H-7

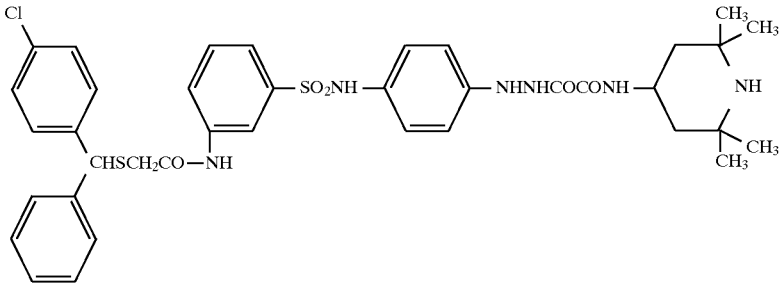

H-20

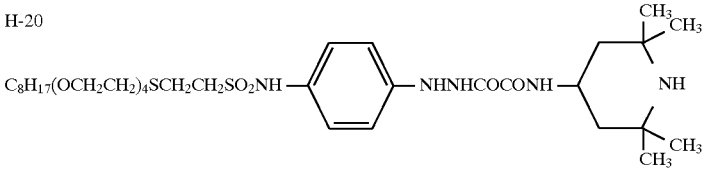

Na-3

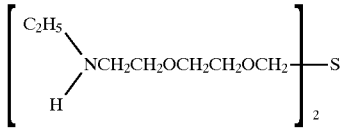

Nb-12

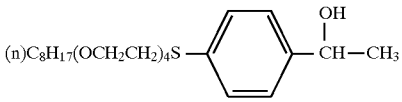

Thus prepared sample was processed using developer CDM-681 and fixer CFL881 (each produced by Konica Corp.). Processing was conducted using an automatic processor, GX680 (produced by Konica) and the washing time was varied by exchanging transport racks.

Processing conditions:

| Step | Temperature | Time |
|---|---|---|
| Developing | 35° C. | 15 sec. |
| Fixing | 35° C. | 11 sec. |
| Washing | 18° C. | Table 1 (Tank vol. = 15 liters) |
| Drying | 50° C. | 11 sec. |

The developing time or fixing time refers to the period of time from immersion into a solution to insertion to the subsequent step. To fully define the sterilizing time, the washing time is expressed as the total dipping time in the liquid.

The photographic material, as prepared above was processed in an amount of 300 sheets (Daizen-size, 20×24") per day and processing was continued for a period of 2 weeks. Sampling water out of the washing tank after 2 weeks, the number of fungi was determined based on the surface plate method. In the above processing, 150 of the 300 sheets were exposed under a fluorescent lamp.

With respect to residual color of the photographic material, 5 unexposed photographic material sheets were processed instead of the 300th sheet after two weeks. The density of 5 stacked sheets was measured by X-Rite and ⅕ of the value was used the density of one sheet. In the case when the residual color was uneven, a portion with high density was measured.

Additives as shown in Table 1, each was added in proportion to the processing amounts at an adding inlet, provided in the vicinity of the water supply to the washing tank. Solid materials were each added in the form of an aqueous 1 wt.% solution.

UV irradiation was conducted using a commercially available U-shaped UV lamp (low pressure mercury lamp) at a wavelength of 254 nm. The lamp was affixed over the washing tank and photographic materials were exposed during processing thereof.

A Clean Bio-sheet was allowed to settle at the bottom of the washing tank and the corners of the sheet were fixed with an adhesive.

As to the ultrasonic method, using a commercially available ultrasonic generator, an ultrasonic oscillator was provided at the bottom of the washing tank and operated at 150 mW.

Regarding the ozone method, using a silent discharge type ozonizer, ozone containing air was blew in the washing tank at a rate of 1.2 liters/min. for 1 min. and air blowing was repeated at 5 min. intervals.

Electrolysis was conducted using porous graphite electrodes (8 discs of 75 mm in diameter and 9 mm in thickness) at an electrolytic current of 0.1 to 0.2 Amp. and a voltage of 35 V. Washing water was supplied from the tank to a cartridge in which the electrode was housed, at a rate of 2 liters/min. and the water subjected to electrolysis was returned to the tank. Electrolysis was continued during processing.

Results thereof were shown in Table 1.

TABLE 1

| Sample No. | Additives (g/1) or treatments | | Water washing 1/m$^2$ | sec. | No. of fungus/ ml | Residual color | Remark |
|---|---|---|---|---|---|---|---|
| 1 | — | | 2 | 5 | 20000 | 0.08 | Comp |
| 2 | — | | 2 | 15 | 30000 | 0.09 | Comp |
| 3 | — | | 7 | 15 | 8000 | 0.07 | Comp |
| 4 | Dichloroisocyanurate.Na | (0.05) | 2 | 5 | 70 | 0.04 | Inv. |
| 5 | Trichloroisocyanurate.Na | (0.05) | 2 | 5 | 80 | 0.04 | Inv. |
| 6 | 2-Pyridylthiol oxide.Na | (0.02) | 2 | 5 | 60 | 0.03 | Inv. |
| 7 | 2-Methylisothiazoline-3-one.$Mg(NO_3)_2$ | (0.02) | 2 | 5 | 70 | 0.03 | Inv. |
| 8 | 2-Methyl-4-chloroiso-thiazoline-3-one.$Mg(NO_3)_2$ | (0.02) | | 5 | 50 | 0.04 | Inv. |
| 9 | 2-bromo-2-nitropropane-1,3-diol | (0.01) | 2 | 5 | 50 | 0.04 | Inv. |
| 10 | Hydrogen peroxide (6%) | (2.0) | 2 | 5 | 10 | 0.03 | Inv. |
| 11 | Hydrogen peroxide (6%) | (2.0) | 7 | 5 | 2 | 0.02 | Inv. |
| 12 | Hydrogen peroxide (6%) | (2.0) | 7 | 15 | 30 | 0.03 | Inv. |
| 13 | Clean Bio-sheet | | 2 | 5 | 80 | 0.04 | Inv. |
| 14 | Ultrasonic 150 mW | | 2 | 5 | 20 | 0.04 | Inv. |
| 15 | UV irradiation | | 2 | 5 | 20 | 0.03 | Inv. |
| 16 | Ozone | | 2 | 5 | 15 | 0.03 | Inv. |
| 17 | Electrolysis | | 2 | 5 | 3 | 0.02 | Inv. |

As can be seen from the Table, inventive samples achieve improvements in residual color.

Example 2

The same photographic material, processing solutions and processor as those in Example 1 were employed, except that the gears of the washing rack which were made of a resin containing a compound as shown in Table 2 were employed, and plastic resin guides in the U-turn portion of the rack, the bottom and the interior walls of the tank were coated with a paint containing the compound as shown in Table 2. The content of the compound in the resin or the coating was 1.5% by weight.

In Sample No.21 of Table 2, the employed gears were conventional ones and the guides and the walls were coated with a paint not containing the compound of Table 2, there was employed an aqueous white paint (a product of Nihon Paint Co.).

TABLE 2

| Sample No. | Additives (g/1) or treatments | Water washing 1/min. | sec. | No. of fungus/ ml | Residual color | Remark |
|---|---|---|---|---|---|---|
| 21 | — | 3 | 6 | 30000 | 0.08 | Comp. |
| 22 | Apacider A35 | 3 | 6 | 70 | 0.04 | Inv. |
| 23 | Apacider NB | 3 | 6 | 80 | 0.04 | Inv. |
| 24 | Stearate · Mg | 3 | 6 | 80 | 0.04 | Inv. |
| 25 | Stearate · Li | 3 | 6 | 80 | 0.04 | Inv. |
| 26 | Holon Killers beads cella CC37-105W | 3 | 6 | 60 | 0.04 | Inv. |
| 27 | Holon Killers beads cella 37–135 | 3 | 6 | 60 | 0.04 | Inv. |
| 28 | Aminometal | 3 | 6 | 40 | 0.03 | Inv. |

As can be seen from the Table, the inventive led to improved results in residual color.

Example 3

The same photographic material, processing solutions and processor as those in Example 1 were employed, provided that instead of washing water was employed a rinsing solution, as below, at a replenishing rate of 60 ml/m$^2$.

Composition of rinsing solution (per liter of working solution):

| | |
|---|---|
| EDTA.2Na | 40 g |
| Potassium hydroxide | 23 g |
| Potassium carbonate | 12 g |
| Potasiium sulfite | 110 g |
| Sanback-P (product by Sanai Sekiyu Co.) | 20 g |
| Water to make | 1 liter |

Results thereof are shown in Table 3.

TABLE 3

| Sample No. | Additives (g/1) or treatments | | No.of fungus/ml | Residual color | Remark |
|---|---|---|---|---|---|
| 1 | — | | 25000 | 0.08 | Comp |
| 2 | — | | 32000 | 0.09 | Comp |
| 3 | — | | 8500 | 0.07 | Comp |
| 4 | Dichlorosocyanurate.Na | (0.05) | 80 | 0.04 | Inv. |
| 5 | Trichloroisocyanurate.Na | (0.05) | 85 | 0.04 | Inv. |
| 6 | 2-Pyridylthiol oxide.Na | (0.02) | 65 | 0.03 | Inv. |
| 7 | 2-Methylisothiazoline-3-one.$Mg(NO_3)_2$ | (0.02) | 65 | 0.03 | Inv. |
| 8 | 2-Methyl-4-chloroiso-thiazoline-3-one.$Mg(NO_3)_2$ | (0.02) | 55 | 0.04 | Inv. |
| 9 | 2-bromo-2-nitropropane-1,3-diol | (0.01) | 56 | 0.04 | Inv. |
| 10 | Hydrogen peroxide (6%) | (2.0) | 14 | 0.03 | Inv. |
| 11 | Clean Bio-sheet | | 75 | 0.04 | Inv. |
| 12 | Ultrasonic 150 mW | | 30 | 0.04 | Inv. |
| 13 | UV irradiation | | 25 | 0.03 | Inv. |
| 14 | Ozone | | 12 | 0.03 | Inv. |
| 15 | Electrolysis | | 4 | 0.02 | Inv. |

As can be seen from the Table, the inventive led to improved results in residual color, even when rinsing solutions were employed.

What is claimed is:

1. A method for processing a silver halide light sensitive photographic material by using an automatic processor comprising the steps of developing an exposed photographic material with a developing solution in a developing tank, fixing with a fixing solution in a fixing tank and washing with a washing water or a rinsing solution in a washing tank, wherein an antibacterial agent is incorporated, in an amount of 0.5 to 10% by weight, in a resin which is used for the washing tank, or a gear or guide employed in the washing tank; or a coating containing an antibacterial agent in an amount of 0.5 to 10% by weight is provided on at least a portion of a bottom and walls of the washing tank, so that said washing water or a rinsing solution is maintained to have a number of fungi of 100 or less per ml.

2. The processing method of claim 1, wherein in the step of washing, water or a rinse is replenished to the tank at a rate of 30 ml to 6 liters per $m^2$ of the photographic material.

3. The processing method of claim 1, wherein in the step of washing, the photographic material is immersed in said washing water or rinsing solution for a period of 1 to 10 sec.

4. The processing method of claim 1, wherein the antibacterial agent is incorporated in a resin which is used for the washing tank, or the gear or guide employed in the washing tank.

5. The processing method of claim 1, wherein the coating containing an antibacterial agent is provided on at least a portion of the bottom and walls of the washing tank.

6. The processing method of claim 1, wherein the fungi in the washing water or rinsing solution are maintained at 10 or less per ml.

7. The processing method of claim 6, wherein in the step of washing, water or a rinse is replenished to the tank at a rate of 30 ml to 6 liters per $m^2$ of the photographic material; and in the step of washing, the photographic material is immersed in said washing water or rinsing solution for a period of 1 to 10 sec.

8. The processing method of claim 1, wherein in the step of washing, water or a rinse is replenished to the tank at a rate of 30 ml to 6 liters per $m^2$ of the photographic material; and in the step of washing, the photographic material is immersed in said washing water or rinsing solution for a period of 1 to 10 sec.

* * * * *